United States Patent [19]

Acker et al.

[11] 4,213,004

[45] Jul. 15, 1980

[54] HERMETIC ELECTRICAL FEEDTHROUGH FOR ALUMINUM HOUSING AND METHOD OF MAKING SAME

[75] Inventors: Roy M. Acker, Los Angeles; Kenneth Lui, Fountain Valley, both of Calif.

[73] Assignee: The United States of America as represented by the Secretary of the Air Force, Washington, D.C.

[21] Appl. No.: 921,138

[22] Filed: Jun. 30, 1978

[51] Int. Cl.[2] ..... H01B 17/26

[52] U.S. Cl. ..... 174/151; 29/592 R; 174/152 GM; 219/118

[58] Field of Search ..... 174/50.61, 50.63, 151, 174/152 GM; 29/592 R, 630 R, 631; 219/85 H, 118

[56] References Cited

U.S. PATENT DOCUMENTS

| | | | |
|---|---|---|---|
| 2,200,694 | 5/1960 | Gerecke et al. | 174/152 GM |
| 3,017,452 | 1/1962 | Rongved | 174/152 GM |

FOREIGN PATENT DOCUMENTS

| | | | |
|---|---|---|---|
| 466556 | 7/1975 | U.S.S.R. | 174/152 GM |

OTHER PUBLICATIONS

*Welding Handbook*, 6th Edition, Section Three-Part A, "Welding, Cutting and Related Processes", published by American Welding Society, New York, 1970, pp. 47.39–47.43.

*Metals Handbook*, 8th Edition, vol. 6, "Welding and Brazing", published by American Society for Metals, Metals Park, Ohio, 1974, pp. 558–560.

*Primary Examiner*—Laramie E. Askin

*Attorney, Agent, or Firm*—Joseph E. Rusz; Robert Kern Duncan

[57] ABSTRACT

A leak-tight joint between a Kovar ceramic feedthrough and an aluminum housing is obtained by electron beam welding a short length of the outside surface of the Kovar cylindrical shell of the feedthrough to a region of nickel deposited on a thin wall cylindrical tube of aluminum formed in the aluminum housing.

2 Claims, 2 Drawing Figures

HERMETIC ELECTRICAL FEEDTHROUGH FOR ALUMINUM HOUSING AND METHOD OF MAKING SAME

RIGHTS OF THE GOVERNMENT

The invention described herein may be manufactured and used by or for the Government of the United States for all governmental purposes without the payment of any royalty.

BACKGROUND OF THE INVENTION

The field of the invention is in the hermetic electrical feedthrough art.

Electrical feed-through connectors for hermetically sealed containers normally incorporate a ceramic insulator and Kovar metal for the connector pin and housing. Kovar is a well known, commerically available nickel-cobalt-iron alloy which has a low coefficient of expansion which is compatible with the coefficient of expansion of certain glasses and ceramic materials. Because of this compatibility, Kovar is commonly used to make hermetic seals. If Kovar connectors are used in lightweight aluminum housings, a problem is created by the incompatibility of the Kovar and aluminum. These two materials cannot be readily joined by welding or brazing. With a suitable plating, the two materials can be soldered, but due to the great difference in coefficient of expansion, high thermal stresses are induced during moderate temperature changes which exceed the capability of common solders. Consideration has also been given to the use of a soft metal gasket or seal ring between a flange on the Kovar seal and the aluminum housing, but with temperature changes there is relative motion at the seal, and with sufficient cycles the relative mechanical motion causes a leak to be created. The Kovar ceramic feed-through can be sealed to an aluminum housing with elastomeric seals, but even with the best type of rubber, such as Butyl, gases can permeate through the elastomeric seal at a rate which may not be acceptable for long-term applications.

The best known prior art is that described by the following patents: U.S. Pat. No. 2,459,193 to patentees Sparks et al; U.S. Pat. No. 3,189,677 to patentees Anthony et al; U.S. Pat. No. 3,637,917 to patentee Oates; and U.S. Pat. No. 3,865,970 to patentee Vrijssen.

SUMMARY OF THE INVENTION

The invention provides a hermetic leak-tight joint between a Kovar ceramic feed-through connector and an aluminum housing that will withstand a large number of thermal cycles without failure.

DESCRIPTION OF THE PREFERRED EMBODIMENT

Figure 1:
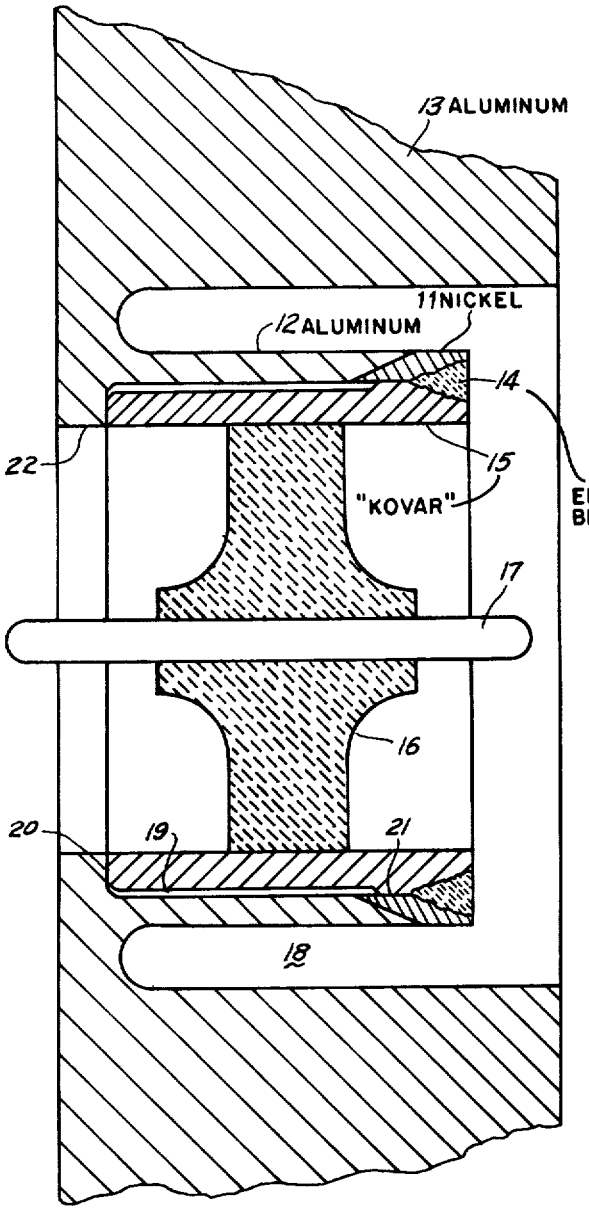
FIG. 1 is a schematic section view of an embodiment of the invention.
Figure 2:
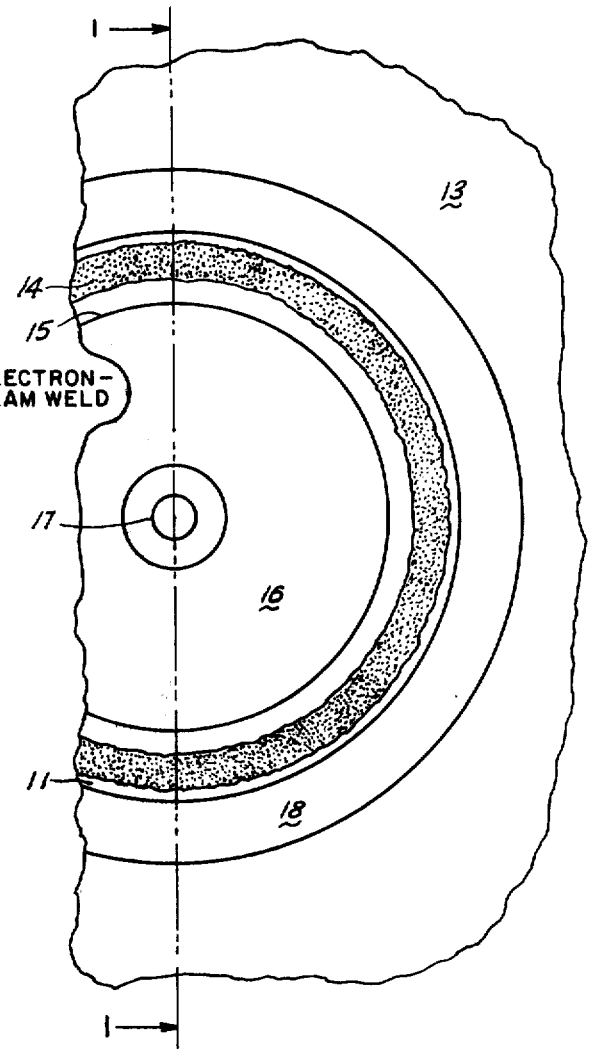
FIG. 2 is a schematic partial end view of the embodiment of FIG. 1.

Referring to FIGS. 1 and 2, the invention solves the aforementioned problem by the application of nickel 11, by plating or deposition, to the thin wall section 12 of the aluminum housing 13, and then electron beam welding 14 the Kovar ring or shell 15 to the nickel plating in a joint configuration which minimizes thermal stresses. The thermal stresses that would normally occur when the Kovar shell of a feedthrough is directly positioned in a bore in an aluminum housing are relieved in this invention by machining the aluminum housing 13 to provide a thin wall cylinder 12 which terminates in a small amount of nickel plating 11 and the electron beam weld joint 14. The thin wall aluminum cylinder 12 acts as a flexure which permits some radial deflection to occur without inducing a large load in the weld. With a temperature rise, the aluminum responds, but only a small amount of aluminum adjacent the nickel and Kovar weld is restrained from expanding due to the attachment to the substantially non-expanding Kovar. Flexure takes place along the thin wall aluminum cylinder. Without this flexure in the aluminum cylindrical section, a large mass of aluminum in the housing that would surround the Kovar feedthrough would be acting to attempt to cause the Kovar to expand with it and would cause high loads to be exerted at the attachment of the Kovar to the housing resulting in a breaking of the attachment or the breaking of the feedthrough itself either at the attachment of the ring 15 to the ceramic or glass insulating member 16, the insulating member 16, or the attachment of the feedthrough electrical conductor 17 to the insulator 16.

The nickel plating 11 provides material which can be compatibly welded to the Kovar. The amount of nickel built upon the thin wall aluminum cylinder is limited to a relatively small and just sufficiently large enough amount to provide a satisfactory weld to be made with the Kovar. This small amount is desirable in order to obtain the advantage of the greater flexibility that aluminum has over nickel. The modulus of elasticity of aluminum is about one-third that of nickel.

The radial width of material removed at 18 is not critical and is mainly determined by ease of machining operations. Typically it is approximately twice the width of the thin wall cylinder 12 which is typically approximately the same thickness, or slightly greater than the Kovar ring 15. Generally it is desirable that the recess 18 be approximately the same depth as the axial thickness of the feedthrough. It is desirable that the thin wall cylindrical section 12 be attached to the Kovar shell 15 (through the nickel), only over a relatively short distance at the ends of each by weld 14, and that radial clearance 19 be provided over the rest of the length of the feedthrough to provide for movement clearance during flexure. Generally, the Kovar shell 15 seats on the aluminum housing 13 at the bottom 20 of the counter bore in the housing. Conventional Kovar feed-throughs having a small external shoulder 21 at one end of the mounting ring shell are used in the invention. In fabricating the invention it is generally desirable to first bore a through-hole 22 in the aluminum housing 13, and machine the channel recess 18, providing a protruding aluminum cylinder having a free end. The nickel is then plated in a "V" notch machined in the free end of the aluminum cylinder, and built up to a height approximately equal to that of the feedthrough. A counter bore is then machined on the inside of the aluminum cylinder reducing it to the desired thickness which also provides shoulder 20 and a smooth surface in the nickel adjacent to the Kovar shoulder 21. Conventional electro plating or deposition may be used to provide the desired amount of nickel. Electron beam weld 14 is also conventionally made.

We claim:

1. The improvement in mounting a ceramic electrical feedthrough insulator having a low coefficient of expansion nickel-cobalt-iron alloy cylinder with an exterior shoulder, in an aluminum housing comprising the steps of:

a. through-boring a hole in the aluminum housing;
b. machining a channel recess in the aluminum housing concentric with the said through-bore providing an aluminum cylinder having a free end;
c. plating a region of nickel on the said free end of the aluminum cylinder;
d. machining a counter bore in the inner surface of the said aluminum cylinder providing a thin wall cylinder of aluminum having a nickel end region;
e. positioning the said feedthrough insulator in the said counter bore with the said exterior shoulder adjacent the said nickel end region; and
f. electron beam welding the said exterior shoulder of the said feedthrough to the said nickel region.

2. Structure for providing a hermetic electrical feedthrough for an aluminum housing comprising:

a. a cylindrical electrical feedthrough insulator having an exterior nickel-cobalt-iron alloy shell enclosing an insulator and central conductor, with a shoulder of determined diameter positioned at one end of the said shell;
b. a thin walled aluminum cylinder having a free end fabricated in the said aluminum housing having an inside diameter approximately equal to the said shoulder diameter;
c. a nickel region attached to the free end of the said thin walled cylinder;
d. the said cylindrical feedthrough insulator positioned within the said thin walled aluminum cylinder with the said shoulder of the nickel-cobalt-iron shell adjacent the said nickel region; and
e. an electron beam weld fabricated in the said adjacent nickel and nickel-cobalt-iron.

* * * * *